US006817271B2

(12) United States Patent
Gouws

(10) Patent No.: US 6,817,271 B2
(45) Date of Patent: Nov. 16, 2004

(54) WRENCH FOR USE WITH DRILLING APPARATUS

(76) Inventor: Petrus Christiaan Gouws, Postnet Suite 254, Private Bag X7260, Witbank 1035 (ZA)

( * ) Notice: Subject to any disclaimer, the term of this patent is extended or adjusted under 35 U.S.C. 154(b) by 0 days.

(21) Appl. No.: 10/240,441

(22) PCT Filed: Mar. 28, 2001

(86) PCT No.: PCT/IB01/00507

§ 371 (c)(1),
(2), (4) Date: Sep. 30, 2002

(87) PCT Pub. No.: WO01/72476

PCT Pub. Date: Oct. 4, 2001

(65) Prior Publication Data

US 2003/0131689 A1 Jul. 17, 2003

(30) Foreign Application Priority Data

Mar. 31, 2000 (ZA) ..... 2000/1647

(51) Int. Cl.[7] ..... B25B 13/50

(52) U.S. Cl. ..... 81/57.33; 81/57.19; 81/57.25; 81/57.35

(58) Field of Search ..... 81/57.33, 57.34, 81/57.15, 57.16, 57.19, 57.2, 57.24, 57.35, 57.4, 57.39, 57.44, 57.42, 98, 109, 106

(56) References Cited

U.S. PATENT DOCUMENTS 1,599,808 A 9/1926 Coates
1,690,007 A 10/1928 Greve
1,855,143 A 4/1932 Williams
4,194,419 A * 3/1980 Mitchhart et al. ..... 81/57.33
4,308,767 A 1/1982 Wilmeth ..... 81/57.39
5,791,206 A * 8/1998 Daigle et al. ..... 81/57.33
6,012,360 A 1/2000 Concha ..... 81/57.39

FOREIGN PATENT DOCUMENTS

WO WO 8909115 10/1989

OTHER PUBLICATIONS

International Search Report corresponding to PCT/IB01/00507 Mailed on Oct. 23, 2001.

* cited by examiner

*Primary Examiner*—Debra S. Meislin
(74) *Attorney, Agent, or Firm*—Myers Bigel Sibley & Sajovec

(57) ABSTRACT

The invention relates to a wrench for use with drilling apparatus used for drilling holes in the ground with a drill bit comprising a drilling segment, extension segments and a distance piece which connects the drill bit to the apparatus. The drill bit segments are connected via complementary threads in a spigot and socket fashion and the wrench serves to loosen adjacent segments with respect to one another in order to accommodate the insertion or removal of extension segments. The wrench (10) comprises a gripping arm (12), defining a mouth formation locatable around a drill bit segment (26), and a lever (18) pivotally connected to the arm. The lever defines a wedge face (34) which, through initial displacement of the lever can urge the drill bit segment (26) into gripping engagement with opposing gripping formations (30) located on the gripping arm and through continued displacement can loosen the drill bit segment with respect to an adjacent segment.

8 Claims, 4 Drawing Sheets

WRENCH FOR USE WITH DRILLING APPARATUS

RELATED APPLICATIONS

This application claims priority under 35 U.S.C. §371 from PCT Application No. PCT/IB01/00507, filed in English on Mar. 28, 2001, which claims the benefit of South African Application Serial No. 2000/1647 filed on Mar. 31, 2000, the disclosure of which is incorporated by reference herein in its entireties.

THIS INVENTION relates to a wrench for use with drilling apparatus.

The invention relates in particular to a wrench for use with drilling apparatus of the type used for drilling holes in the ground and where the drill bit comprises a drilling segment that defines the leading end of the drill bit and a plurality of extension segments that can be linked with the drilling segment for extending the length thereof. Such a drill bit generally includes also a segment, referred to as a distance piece, that links the remainder of the drill bit to the chuck of the drilling apparatus. Holes to be drilled in the ground with a drill bit as described are required in relation to various mining and other applications.

A drilling operation thus provides for a hole to be drilled to a depth permitted by the length of a drill bit at a particular time, whereafter an extension segment is inserted in line with the drill bit which, in effect, permits the drilling apparatus to be retracted by a distance equal to the length of the extension segment and then for drilling to continue until a further extension segment must be inserted in line with the drill bit.

Insofar as this mode of drilling a hole in the ground is well known, this is not described in further detail herein.

The drilling segment, the extension segments and the distance piece of a drill bit as herein envisaged, hereinafter merely referred to as the drill bit segments of a drill bit, are axially connected with one another via complementary threads in a spigot and socket fashion, the threads being configured to provide for effective tightening together of the segments during actual drilling. In order to insert an extension segment it is thus required to loosen the two adjacent connected segments, between which the extension segment must be inserted, with respect to one another, such loosening permitting separation of the segments. It is this loosening operation that often presents difficulties and that requires the use of a special wrench, hereinafter referred to as a drill bit wrench. The same difficulties occur also when a drill bit is withdrawn from a hole drilled and extension segments must be removed from the drill bit, which, in effect, requires a reverse operation to that required for inserting extension segments in line with a drill bit.

Known drill bit wrenches generally have a pair of opposing jaws, between which a drill bit segment can be gripped, and a lever that is displaceable for acting on the jaws and thereby for rotating a drill bit segment gripped between the jaws. Preferred wrenches of the type provide for the jaws to be pivotally connected to one another and for the lever to extend from one of the jaws, in a configuration in which displacement of the lever will enhance the gripping force of the jaws on the drill bit segment gripped between them. However, the gripping force that can be applied on a drill bit segment with known drill bit wrenches have not proved sufficient in all cases for loosening adjacent drill bit segments with respect to one another, the jaws tending to slip with respect to a drill bit segment gripped between them and thus not permitting required loosening.

It is accordingly an object of this invention to provide an improved drill bit wrench for loosening adjacent drill bit segments of a drill bit with respect to one another, as herein envisaged.

According to the invention there is provided a drill bit wrench for loosening a drill bit segment of a drill bit, having a diameter falling within a predetermined diameter range, with respect to an adjacent drill bit segment, which comprises

- a gripping arm that has two ends and that defines an open mouth formation between the said two ends that permit the arm to be located around the drill bit segment to be loosened; and
- a lever that is pivotally connected to and that extends from one end of the gripping arm, and in which, with the gripping arm located around the drill bit segment to be loosened and with respect to a reference line extending from the pivot axis defined by the pivotal connection between the lever and the said one end of the gripping arm, through the longitudinal axis defined by the drill bit segment and the other end of the gripping arm, the gripping arm has a gripping formation, near the said other end of the gripping arm and that opposes the drill bit segment, on each side of the said line and the lever defines a convex wedge face that, by initial displacement of the lever in a direction that coincides with the required direction of rotation of the drill bit segment for loosening the drill bit segment, can wedge against the drill bit segment, acting on the drill bit segment in the region of the segment immediately adjacent the location where the said reference line intersects the face of the drill bit segment, for urging the drill bit segment into gripping engagement with the gripping formations and for permitting loosening of the drill bit segment with respect to an adjacent drill bit segment by continued displacement of the lever.

The gripping formations of the gripping arm each may comprise a gripping bit located within the gripping arm and defining an exposed, serrated face into which a drill bit segment can be urged for the gripping engagement thereof by the gripping formation.

The gripping formations may be located to engage a drill bit segment in locations of the segment that fall between two limit positions determined by the locations where two lines, extending respectively from the pivotal axis between the gripping arm and the lever at an angle of 12° with respect to the reference line, on opposite sides of the reference line, intersect the drill bit segment on the side thereof where the gripping formations oppose the drill bit segment. Preferably, the gripping formations are located to engage a drill bit segment in locations of the segment that coincide substantially with the locations where two lines, extending respectively from the pivotal axis between the gripping arm and the lever at an angle of 8° with respect to the reference line, on opposite sides of the reference line, intersect the drill bit segment on the side thereof where the gripping formations oppose the drill bit segment.

The convex wedge face defined by the lever particularly may be profiled to act on a drill bit segment in a region of the segment defined between locations where the said reference line and a line extending from the pivotal axis between the gripping arm and the lever at an angle of 12° with respect to the reference line, intersect the drill bit segment. Preferably, the convex wedge face defined by the lever is profiled to act on a drill bit segment in the region of the segment defined between locations where the said reference line and a line extending from the pivotal axis defined between the gripping arm and the lever at an angle of 8° with respect to the reference line, intersect the drill bit segment.

The drill bit wrench of the invention further may include a primary displacement means that can act on the lever for displacing the lever. The primary displacement means particularly is a piston/cylinder arrangement.

The drill bit wrench further may include a secondary displacement means whereby the gripping arm can be displaced with respect to the lever, for locating the gripping arm around a drill bit segment. The secondary displacement means also may be a piston/cylinder arrangement.

Still further according to the invention, the lever may have an extension piece adjustably engaged therewith near the end of the lever remote from the end pivotally connected with the gripping arm, the extension piece rendering the length of the lever adjustable. The drill bit wrench particularly includes more than one extension piece with the extension pieces permitting replacement of one another for accommodating different applications of the drill bit wrench.

In use of the drill bit wrench of the invention and with the mouth of the gripping arm located around a drill bit segment to be loosened with respect to another segment, the displacement of the lever with respect to the gripping arm will provide for effective gripping of the drill bit segment by the gripping formations of the gripping arm, with continued displacement of the lever providing for loosening of the drill bit segment as required. As the force required for loosening a drill bit segment with respect to another increases, the action of the lever on the drill bit segment urging it into gripping engagement with the gripping formations of the gripping arm also will increase, particularly to the extent that the gripping engagement of the drill bit segment will be such that slipping between the gripping formations and the drill bit segment cannot occur and loosening of the drill bit segment is permitted without undue difficulties.

The invention is now described, by way of examples, with reference to the accompanying diagrammatic drawings, in which.

Figure 1:
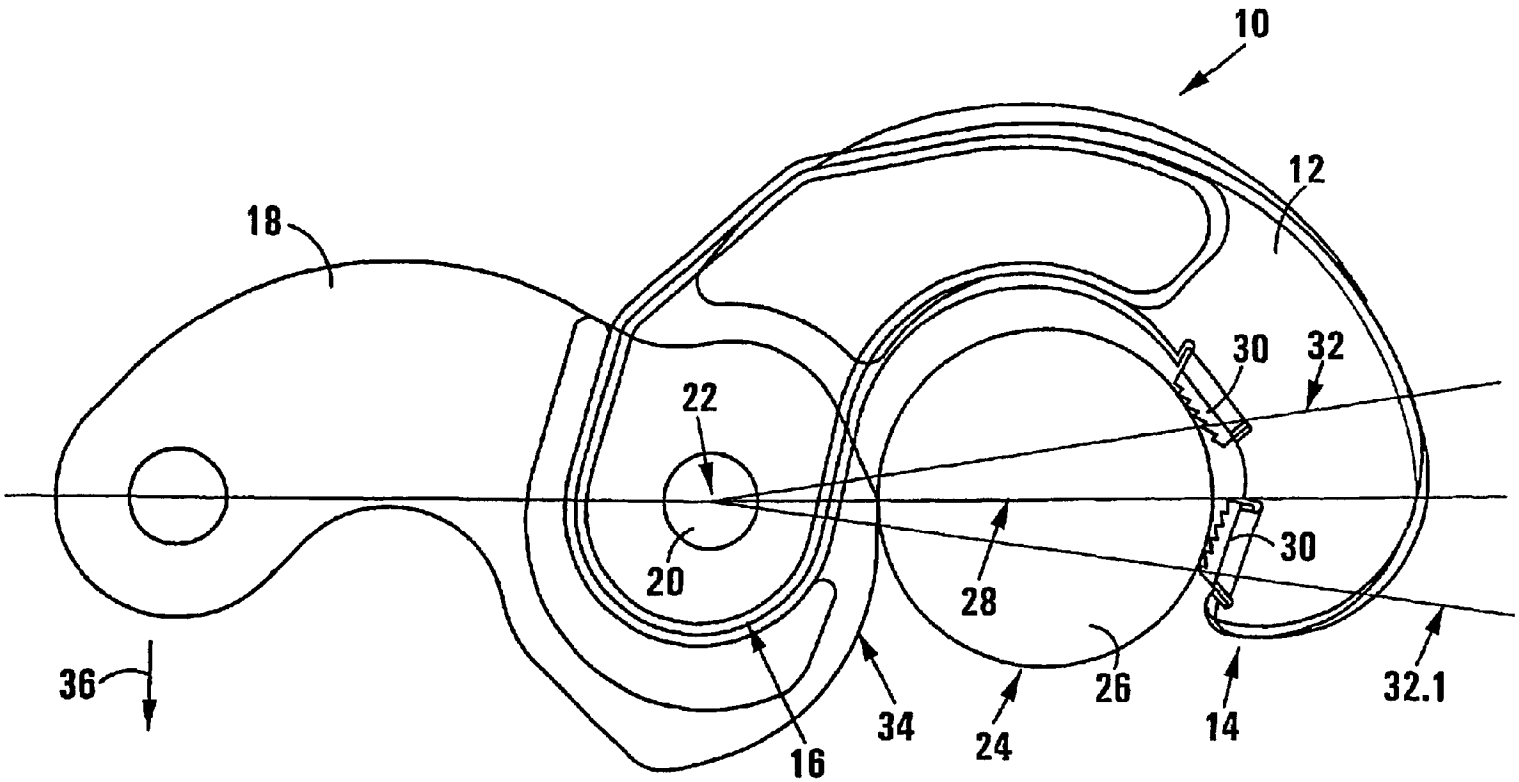
FIG. 1 shows an elevational view of a first embodiment of a drill bit wrench, in accordance with the invention.

Referring initially to FIG. 1 of the drawings, a first embodiment of a drill bit wrench, in accordance with the invention, is designated generally by the reference numeral 10. The drill bit wrench 10 includes a gripping arm 12, that has two ends, 14 and 16 respectively, and a lever 18 that is pivotally connected to the end 16 of the gripping arm 12 by a pivot pin 20 that defines a pivot axis 22 between the gripping arm 12 and the lever 18.

The gripping arm 12 defines an open mouth formation 24 between the ends, 14 and 16, thereof, which permits location of the gripping arm around a drill bit segment 26 of a drill bit, the diameter of the drill bit falling within a predetermined diameter range with which the drill bit wrench 10 is to be used.

With the drill bit segment 26 located in the position shown within the mouth formation 24 defined by the gripping arm 12, a reference line 28 can be defined that extends from the pivot axis 22 through the longitudinal axis defined by the drill bit segment 26 and through the gripping arm 12 near the end 14 thereof. Also with the drill bit segment so located, the gripping arm has two gripping formations in the form of gripping bits 30 located therein in locations on opposite sides of the reference line 28, the gripping bits defining serrated gripping faces that directly oppose the drill bit segment 26, as shown. The respective locations of the gripping bits 30 preferably are such that they directly oppose the drill bit segment 26 in locations that coincide substantially with locations where lines 32, extending from the pivot axis 22 at approximately 8° on opposite sides of the reference line 28, intersect respectively the face of the drill bit segment 26, as is clearly shown in FIG. 1. These locations of the gripping bits in practice can vary to the extent that they must oppose the drill bit segment 26 in locations on opposite sides of the reference line 28 within segments defined between equivalent lines to the lines 32, but extending at an angle of not more than 4° with respect to the lines 32, on either side thereof.

The lever 18, at its end where it is pivotally connected to the gripping arm 12, defines a convex wedge face 34 that is profiled to effectively wedge against the gripping arm 12 by the displacement of the lever 18 in the direction of the arrow 36, bearing against the face of the drill bit segment 26 in a location immediately adjacent the location where the reference line 28 intersects the face of the drill bit segment 26, particularly in the location between the points where the lines 28 and 32.1 intersect the face of the drill bit segment 26. It will thus be understood that by this displacement of the lever 18 in the direction of arrow 36, the wedge action of the face 34 on the drill bit segment 26 will urge the drill bit segment 26 towards and into gripping engagement with the gripping bits 30, the urging force acting on the drill bit segment 26 being directed along a line coinciding substantially with the reference line 28.

Any increase in the displacement force acting on the lever 18 in the direction of arrow 36 will enhance the wedge action as described and, as such, the effective gripping engagement of the drill bit segment 26 by the gripping bits 30, particularly to the extent that further displacement of the lever 18 will provide for rotation of the drill bit segment 26 about its longitudinal axis and, as such, required loosening thereof with respect to an adjacent drill bit segment with which it is operatively linked. It is believed that the effectiveness of the gripping action that can be applied on a drill bit segment by the drill bit wrench 10 will be such that loosening of the drill bit segment will occur without any undue difficulties.

It will be understood in the above regard that the gripping arm 12 and the lever 18 of the drill bit wrench 10 can be formed of any suitable material having required strength qualities to fulfill the purpose of the drill bit wrench, whereas the gripping bits 30 can be of suitably hardened materials that can grip the drill bit segment 26 in a manner in which relative slipping is not permitted and loosening of the drill bit segment is thus ensured by the application of a sufficient force on the lever 18, any increase in the force applied to enable loosening clearly enhancing the gripping action and reducing possible slipping of the gripping bits 30 with respect to the drill bit segment 26.

Figure 2:
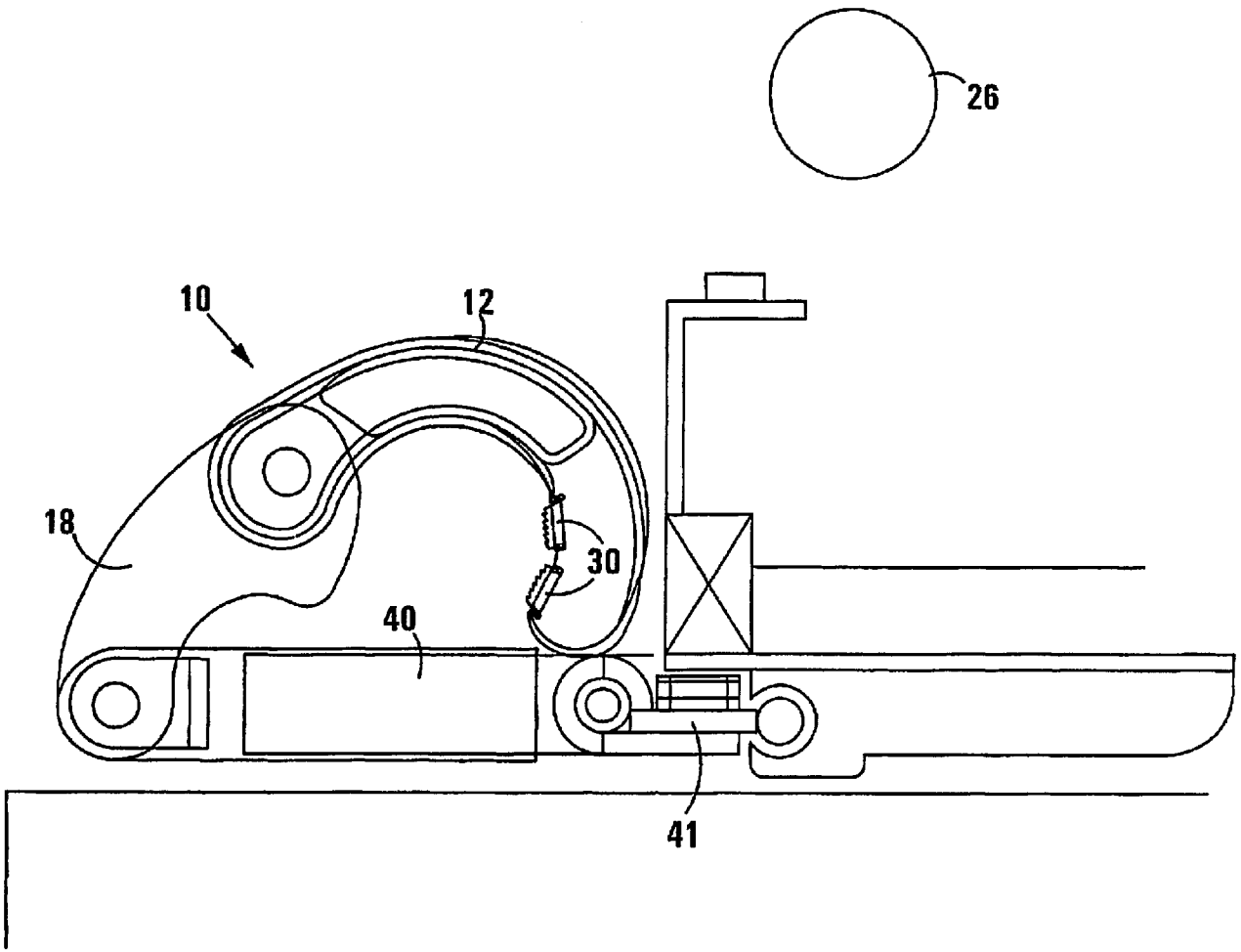
FIG. 2 illustrates schematically the drill bit wrench of FIG. 1, in an inoperative in-use configuration thereof.
Figure 3:
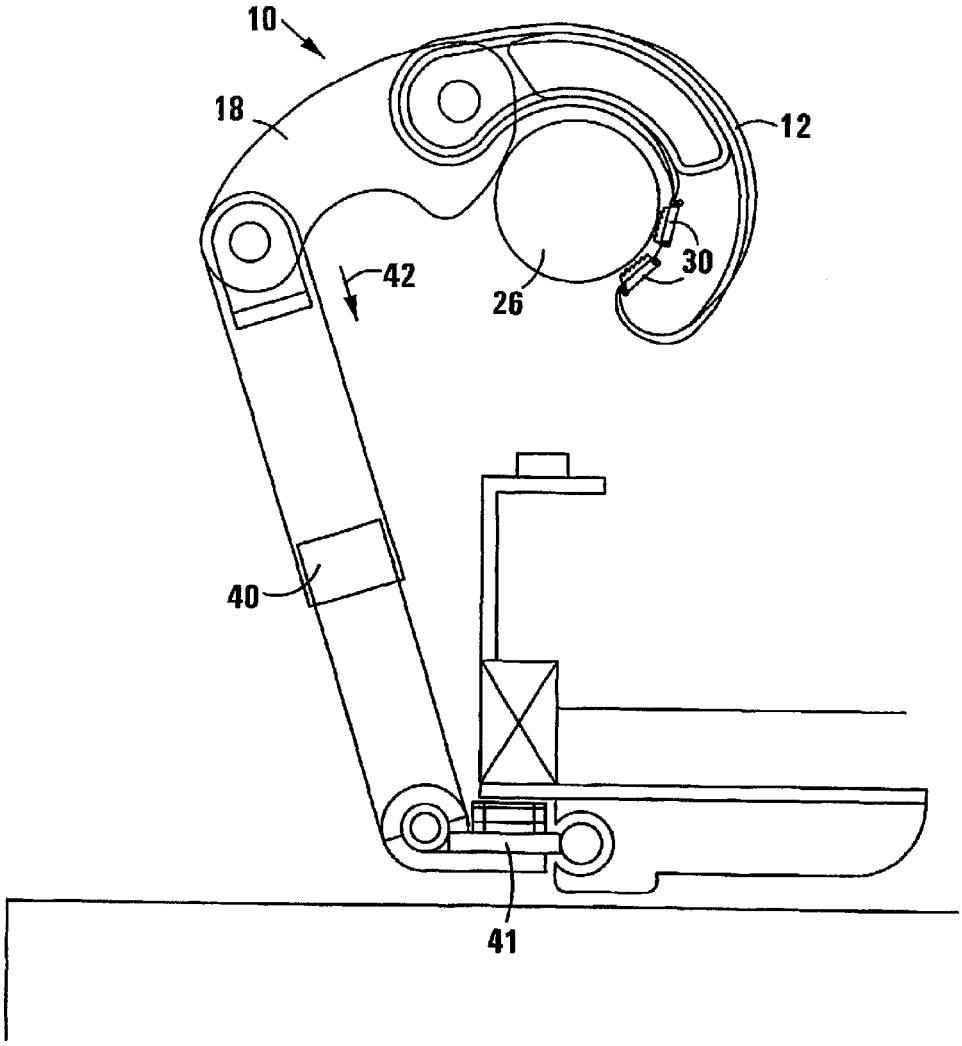
FIG. 3 illustrates schematically the drill bit wrench of FIG. 1, in an operative in-use configuration thereof.

Referring now also to FIGS. 2 and 3 of the drawings, FIG. 2 illustrates the drill bit wrench 10 in an inoperative configuration thereof with respect to a drill bit including segments 26 that are linked to a drilling apparatus for drilling a hole in the ground. The manipulation of the drill bit wrench 10 is controlled by a hydraulic piston/cylinder arrangement 40 that is pivotally linked between the lever 18 and a support 41 therefor.

The drill bit segment 26 shown essentially constitutes the operative upper extension segment of the entire drill bit, i.e. the segment which is releasably connected to the distance piece extending from the chuck of the drilling apparatus to be used for performing a drilling operation. The mode of connection between the segment 26 and the distance piece is the same as the mode of connection between adjacent drill bit segments, i.e. via complementary thread formations engaging one another in a spigot and socket fashion.

When it is required to lengthen the drill bit by inserting an extension segment in line therewith, the segment 26 must be loosened with respect to the distance piece referred to, effectively requiring rotation of the drill bit segment with respect to the distance piece.

In order to initiate this loosening of the drill bit segment 26 with respect to the distance piece, through the operation and manipulation of the piston/cylinder arrangement 40, the carrier arm 12 can be displaced into the configuration as shown in FIG. 3, in which it is located around the drill bit segment 26. By then operating/contracting the piston/cylinder arrangement 40, a force in the direction of arrow 42 is applied to the lever 18, causing the wedge action described above, by the pivotal displacement of the lever with respect to the carrier arm 12, and thereby causing effective gripping engagement of the drill bit segment 26 by the gripping bits 30 of the gripping arm 12. Further contraction of the piston/cylinder arrangement 40 will then provide for rotation of the drill bit 26, particularly to initiate loosening thereof with respect to the distance piece referred to above.

Once loosening has been effected, the piston/cylinder arrangement can be extended to provide for release of the wedge face with respect to the drill bit segment 26, thus permitting displacement of the carrier arm with respect to the drill bit segment 26 and the return of the drill bit wrench to its configuration as shown in FIG. 2. The complete disconnection between the drill bit segment 26 and the distance piece can then be effected by the drilling apparatus itself. A further extension segment can then be located in line with the segment 26, between the segment 26 and the distance piece referred to, with effective tightening between the respective segments being effected by the operation of the drilling apparatus.

It is envisaged that the required manipulation of the gripping arm 12 with respect to the lever 18 can be manually effected, or be effected with the aid of a secondary piston/cylinder arrangement (not shown) that can be operatively connected between the gripping arm 12 and the lever 18.

It will be understood also that following the completion of a drilling operation, the retraction of the drill bit from the ground will require the sequential removal of extension segments from the drill bit and, as such, the loosening of extension segments with respect to one another. This can again be effected with the aid of the drill bit wrench 10, in the manner above described.

The overall configuration of the drill bit wrench of the invention and the specific mode of use thereof clearly is greatly variable, while still incorporating the essential principles of the drill bit wrench as hereinabove described.

Figure 4:
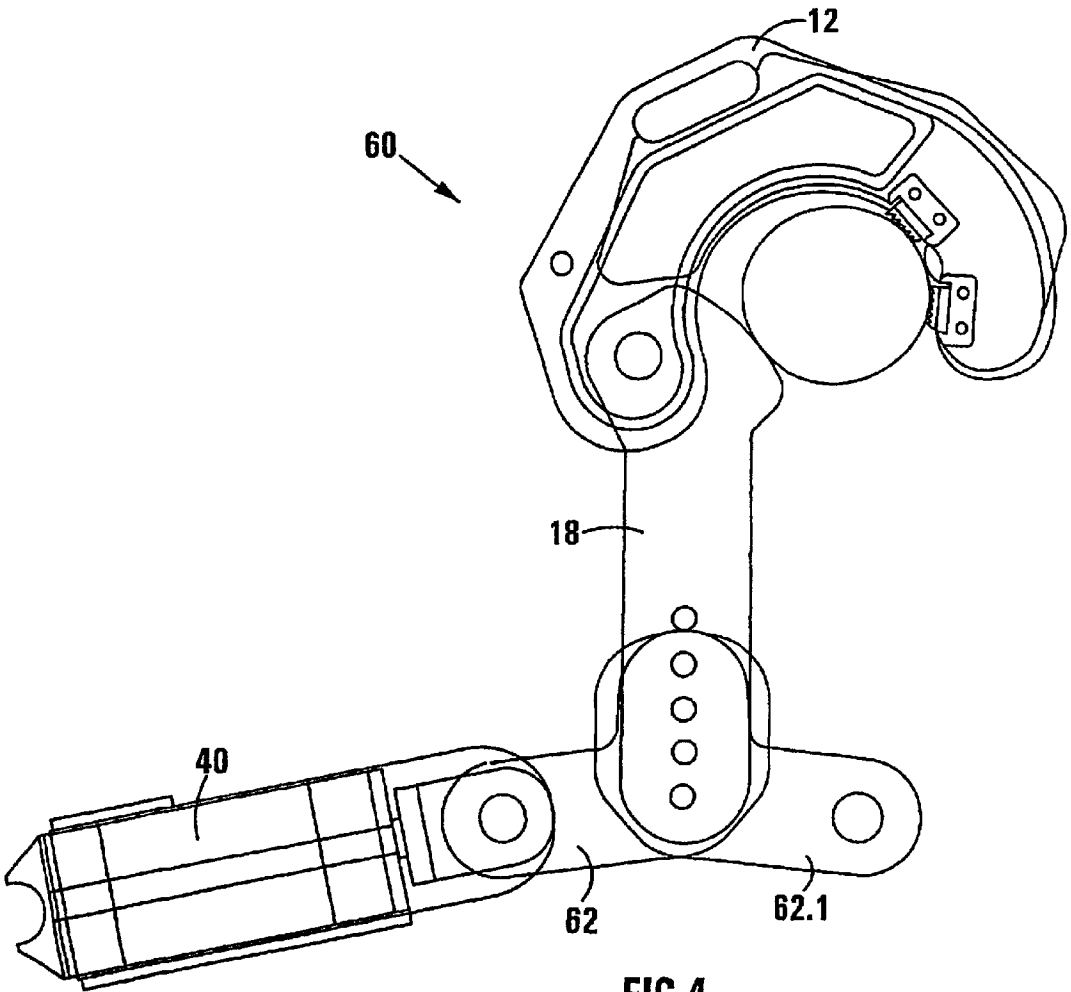
FIG. 4 shows an elevational view of a second embodiment of a drill bit wrench, in accordance with the invention.

Referring particularly to FIG. 4 of the drawings, a second embodiment drill bit wrench, in accordance with the invention, is designated generally by the reference numeral 60. With like parts being designed by the same reference numerals as before, the drill bit wrench 60 again includes a gripping arm 12 and a lever 18, the overall configuration of which is essentially equivalent to that of the corresponding parts of the drill bit wrench 10 as shown in FIG. 1.

The drill bit wrench 60 includes further an extension piece 62 that forms part of the lever 18 and that provides for the required link between the lever 18 and a piston/cylinder arrangement 40, the extension piece 62 permitting effective length adjustment of the lever 18. The same or a different extension piece 62.1 also can serve to alter the relative location of the piston/cylinder arrangement 40 with respect to the lever 18, different configurations in this regard often being required in relation to the location where drilling operations occur and where space constraints may dictate different operative configurations of the piston/cylinder arrangement 40 with respect to the lever arm 18 and also different effective lengths of the lever arm 18. It will thus be understood that the drill bit wrench of the invention can be adapted particularly for various different modes of use and applications while still retaining the operative relationship between the lever and the gripping arm thereof, which permits effective gripping of a drill bit segment for loosening thereof with respect to another drill bit segment, which may be the distance piece whereby the drill bit formed of the drill bit segments is effectively connected to the chuck of the drilling apparatus with which a particular drilling operation is to be performed.

What is claimed is:

1. A drill bit wrench for loosening a drill bit segment of a drill bit, having a diameter falling within a predetermined diameter range, with respect to an adjacent drill bit segment, which comprises:

a gripping arm that has two ends and that defines an open mouth formation between the two ends that permits the arm to be located around a drill bit segment to be loosened;

a lever that is pivotally connected to and that extends from one end of the gripping arm at a pivot axis, separate gripping formations on the other end of the gripping arm, and said lever having a convex wedge face that is disposed at a fixed spacing from the pivot axis;

such that when said gripping formations and said convex wedge face are in engagement with a drill bit segment falling within said predetermined diameter range, a straight reference line is defined that extends from the pivot axis, through a face of the drill bit segment, through the longitudinal axis of the drill bit segment, between the gripping formations, and through the convex wedge face;

whereby displacement of the lever in a direction that coincides with the required direction of rotation of the drill bit segment for loosening the drill bit segment, wedges the convex wedge face against the drill bit segment, in the region of the segment immediately adjacent the location where the said reference line intersects the face of the drill bit segment, for urging the drill bit segment into gripping engagement with the gripping formations.

2. A drill bit wrench as claimed in claim 1, in which the gripping formations of the gripping arm each comprises a gripping bit located within the gripping arm and defining an exposed, serrated face into which a drill bit segment can be urged for the gripping engagement thereof by the gripping formation.

3. A drill bit wrench as claimed in claim 1, in which the gripping formations when engaged with a drill bit segment are located to engage a drill bit segment in locations of the segment that fall between two limit positions determined by the locations where two lines, extending respectively from the pivot axis between the gripping arm and the lever at an angle of 12° with respect to the reference line, on opposite sides of the reference line, intersect the drill bit segment on the side thereof where the gripping formations opposed the drill bit segment.

4. A drill bit wrench as claimed in claim 1, in which the gripping formations when engaged with a drill bit segment are located to engage a drill bit segment in locations of the segment that fall between to limit positions determined by the locations where two lines, extending respectively from the pivot axis between the gripping arm and the lever at an angle of 8° with respect to the reference line, on opposite sides of the reference line, intersect the drill bit segment on the side thereof where the gripping formations oppose the drill bit segment.

5. A drill bit wrench as claimed in claim 1, in which the convex wedge face defined by the lever when engaged with a drill bit segment is profiled to act on a drill bit segment in a region of the segment defined between locations where the said reference line and a line extending from the pivot axis between the gripping arm and the lever at an angle of 12° with respect to the reference line, intersect the drill bit segment.

6. A drill bit wrench as claimed in claim 1, in which the convex wedge face defined by the lever when engaged with a drill bit segment is profiled to act on a drill bit segment in a region of the segment defined between locations where the said reference line and a line extending from the pivot axis defined between the gripping arm and the lever at an angle of 8° with respect to the reference line, intersect the drill bit segment.

7. A drill bit wrench as claimed in claim 1, which includes a primary displacement means that can act on the lever for displacing the lever.

8. A drill bit wrench as claimed in claim 7, in which the primary displacement means is a piston/cylinder arrangement.

* * * * *